US008650712B2

(12) United States Patent
Wach et al.

(10) Patent No.: US 8,650,712 B2
(45) Date of Patent: Feb. 18, 2014

(54) SIDE ADJUSTABLE DOOR HINGE PIN SOCKET MECHANISM

(75) Inventors: Ryan Robert Wach, Glendale, CA (US); John Michael Roche, Bishop, GA (US); Sesha Madireddi, St. Charles, MO (US); Raghujit Kunapuli, St. Charles, MO (US)

(73) Assignee: Anthony, Inc., Sylmar, CA (US)

( * ) Notice: Subject to any disclaimer, the term of this patent is extended or adjusted under 35 U.S.C. 154(b) by 124 days.

(21) Appl. No.: 13/458,837

(22) Filed: Apr. 27, 2012

(65) Prior Publication Data

US 2013/0283566 A1 Oct. 31, 2013

(51) Int. Cl.

| | |
|---|---|
| ***E05F 1/10*** | (2006.01) |
| ***E05F 1/12*** | (2006.01) |
| ***E05F 3/22*** | (2006.01) |

(52) U.S. Cl.

CPC ..... *E05F 1/123* (2013.01); *E05F 3/226* (2013.01)

USPC ..... 16/301; 16/236; 16/240

(58) Field of Classification Search

CPC ..... E05F 1/123; E05F 1/12; E05F 3/226; E05Y 2900/31; E05D 7/0415; E05D 7/0423; E05D 7/04

USPC ..... 16/301, 300, 299, 298, 235, 236, 237, 16/238, 239, 240, 241, 242, 243, 244, 245, 16/246, 249, 308; 49/386

See application file for complete search history.

(56) References Cited

U.S. PATENT DOCUMENTS

| | | | | | |
|---|---|---|---|---|---|
| 998,692 | A | * | 7/1911 | Keene et al. | 16/300 |
| 1,056,171 | A | * | 3/1913 | Henry | 16/242 |
| 1,105,852 | A | * | 8/1914 | Sherwood | 16/285 |
| 3,040,434 | A | | 6/1962 | Yarosz | |
| 3,339,225 | A | * | 9/1967 | Booth | 16/300 |
| 3,858,320 | A | | 1/1975 | Neal | |
| 4,646,472 | A | * | 3/1987 | Sugawara | 49/386 |
| 4,696,078 | A | | 9/1987 | Stromquist | |
| 4,905,347 | A | * | 3/1990 | Wroth | 16/308 |
| 5,074,609 | A | * | 12/1991 | Dear | 296/76 |
| 5,265,954 | A | | 11/1993 | Keil | |
| 5,321,870 | A | * | 6/1994 | Wada et al. | 16/300 |
| 5,333,355 | A | * | 8/1994 | Beswick et al. | 16/300 |
| 5,392,493 | A | * | 2/1995 | Youngdale | 16/237 |
| 5,967,586 | A | * | 10/1999 | Duffy et al. | 296/76 |
| 6,978,516 | B1 | * | 12/2005 | Calderon et al. | 16/235 |
| 7,240,400 | B2 | * | 7/2007 | Bonham | 16/238 |
| 7,334,293 | B2 | * | 2/2008 | Erickson et al. | 16/243 |
| 7,552,511 | B2 | * | 6/2009 | Campbell et al. | 16/238 |

(Continued)

OTHER PUBLICATIONS

International Search Report and Written Opinion issued on Jul. 30, 2013 in related PCT/US2013/038080 application.

*Primary Examiner* — Jeffrey O Brien

(74) *Attorney, Agent, or Firm* — Jeffer Mangels Butler & Mitchell LLP

(57) ABSTRACT

A device for use in a door assembly that is positioned in a cabinet and defines a pivot axis. The device includes a base member adapted to be fixedly secured to the cabinet, an intermediate member slidingly engaged with the base member, and a cover connected to the intermediate member and having a hinge pin socket therein. The intermediate member includes a transversely extending adjustment screw associated therewith that defines a first axis. Rotation of the adjustment screw causes the intermediate member and cover to move in a direction substantially perpendicular to the first axis.

8 Claims, 6 Drawing Sheets

(56) References Cited

U.S. PATENT DOCUMENTS

| | | | | |
|---|---|---|---|---|
| 7,694,389 | B2 * | 4/2010 | Erickson et al. | 16/243 |
| 8,388,077 | B2 * | 3/2013 | Park | 312/405 |
| 2004/0200035 | A1 * | 10/2004 | Fries | 16/238 |
| 2005/0120517 | A1 * | 6/2005 | Bonham | 16/238 |
| 2006/0179610 | A1 * | 8/2006 | Erickson et al. | 16/243 |
| 2007/0143959 | A1 * | 6/2007 | Chung | 16/236 |
| 2008/0209679 | A1 * | 9/2008 | Erickson et al. | 16/245 |
| 2008/0271291 | A1 * | 11/2008 | Chen et al. | 16/238 |
| 2008/0307606 | A1 * | 12/2008 | Karlsson | 16/243 |
| 2009/0089974 | A1 * | 4/2009 | Fries et al. | 16/243 |
| 2010/0242227 | A1 * | 9/2010 | Tagtow et al. | 16/237 |
| 2012/0167342 | A1 * | 7/2012 | Wu et al. | 16/239 |

* cited by examiner

SIDE ADJUSTABLE DOOR HINGE PIN SOCKET MECHANISM

FIELD OF THE INVENTION

The present invention relates generally to refrigerated display cases and refrigerator doors and, more particularly, to a refrigerator door used in grocery stores.

BACKGROUND OF THE INVENTION

The present invention provides a mechanism for applying a varying amount of torque to a fixed external torque and that allows for side to side adjustability of the mechanism when affixed to a stationary base. A prior art device is taught in U.S. Pat. No. 4,696,078 to Stromquist, the entirety of which is incorporated by reference. The present invention improves upon the functionality of the device taught in the '078 patent by changing the placement of the side to side adjustment from the end of the device to the side of the device and changing the internal mechanism to provide such adjustment. The present invention allows for adjustment of door sag while the door remains closed.

Commercial refrigerator doors are often equipped with a torsion spring housed in a device that helps ensure automatic closing of the refrigerator door to keep the cold air in the display case. The device houses the torsion spring, provides easy torque adjustment to ensure door closure at smaller openings and door sag adjustment for squareness of the door within the frame during and post installation. The device taught in the '078 patent requires adjustment on the end of the device or on the side with respect to the case (as opposed to the front).

SUMMARY OF THE PREFERRED EMBODIMENTS

In a preferred embodiment, the side adjustable torque application mechanism includes a worm gear and a sprocket for clock-wise and counter clock-wise rotation of the torque rod seated in the mechanism. The door closing torque is adjusted using a rotatable worm gear and associated components and sag adjustment is provided by a sag adjust screw. In a preferred embodiment, the double headed sag adjust screw is captured in a peg nut, which is captured by a boss within the angular slotted plate. As the screw turns, the peg nut traverses front to back moving the slotted plate side to side, thus moving the housing side to side, with respect to the door.

In accordance with a first aspect of the present invention there is provided a device for use in a door assembly that is positioned in a cabinet and defines a pivot axis. The device includes a base member with a diagonally oriented slot defined therein and that is adapted to be fixedly secured to the cabinet, an intermediate member slidingly engaged with the base member, and a cover connected to the intermediate member. The intermediate member includes a transversely extending adjustment screw associated therewith that defines an axis and has at least one head and a threaded portion with a peg nut thereon that includes a boss extending downwardly into the diagonally oriented slot of the base member. The cover has a hinge pin socket therein and includes an opening defined therein through which the head of the adjustment screw extends. In a preferred embodiment, the adjustment screw includes two non-threaded portions positioned axially on either side of the threaded portion that are each seated in an indentation defined in the intermediate portion. Preferably, the adjustment screw includes a head on each end thereof, and the cover includes openings on each side thereof through which one of the heads of the adjustment screw extends. In a preferred embodiment, the intermediate member and base member comprise mating angled surfaces that prevent the intermediate member from moving upwardly and that allow the intermediate member and cover to slide in a direction substantially perpendicular to the axis defined by the adjustment screw.

In a preferred embodiment, the device further includes a worm wheel rotatively housed in the cover and having a central aperture adapted to matingly receive the end of a torque rod of the door assembly in a non-rotative relationship, and a worm housed by the cover in engaging relationship with the worm wheel and adapted to be selectively turned so as to adjust the torque of the torque rod. Preferably, the worm is seated in a channel defined in the intermediate member.

In accordance with another aspect of the present invention there is provided a device for use in a door assembly that is positioned in a cabinet and defines a pivot axis. The device includes a base member adapted to be fixedly secured to the cabinet, an intermediate member slidingly engaged with the base member, and a cover connected to the intermediate member and having a hinge pin socket therein. The intermediate member includes a transversely extending adjustment screw associated therewith that defines a first axis. Rotation of the adjustment screw causes the intermediate member and cover to move in a direction substantially perpendicular to the first axis. In a preferred embodiment, the device also includes a torque adjustment mechanism that is adapted to adjust the torque of a torque rod of the door assembly. Preferably, the torque rod adjustment mechanism includes a worm wheel and a worm that is rotatable about a second axis that is substantially parallel to the first axis.

In accordance with another aspect of the present invention there is provided a method of adjusting the position of a pivot axis of a door that includes a torque rod having a bottom end positioned in or otherwise associated with a hinge pin socket adjustment device. The method includes rotating an adjustment screw in the hinge pin socket adjustment device. When the adjustment screw is rotated, it rotates about a first axis and the pivot axis of the door moves in a direction substantially perpendicular to the first axis. In a preferred embodiment, the door is positioned in a cabinet and the hinge pin socket adjustment device includes a base that is secured to the cabinet. When the adjustment screw is rotated, the adjustment screw moves in a direction substantially perpendicular to the first axis. The hinge pin socket adjustment device includes an intermediate member slidingly engaged with the base member. The adjustment screw is supported by the intermediate member. In a preferred embodiment, the method further comprises the step of rotating a worm in the hinge pin socket adjustment device to adjust the torque of the torque rod. The worm defines a second axis that is substantially parallel to the first axis.

DETAILED DESCRIPTION OF THE PREFERRED EMBODIMENTS

Figure 1:
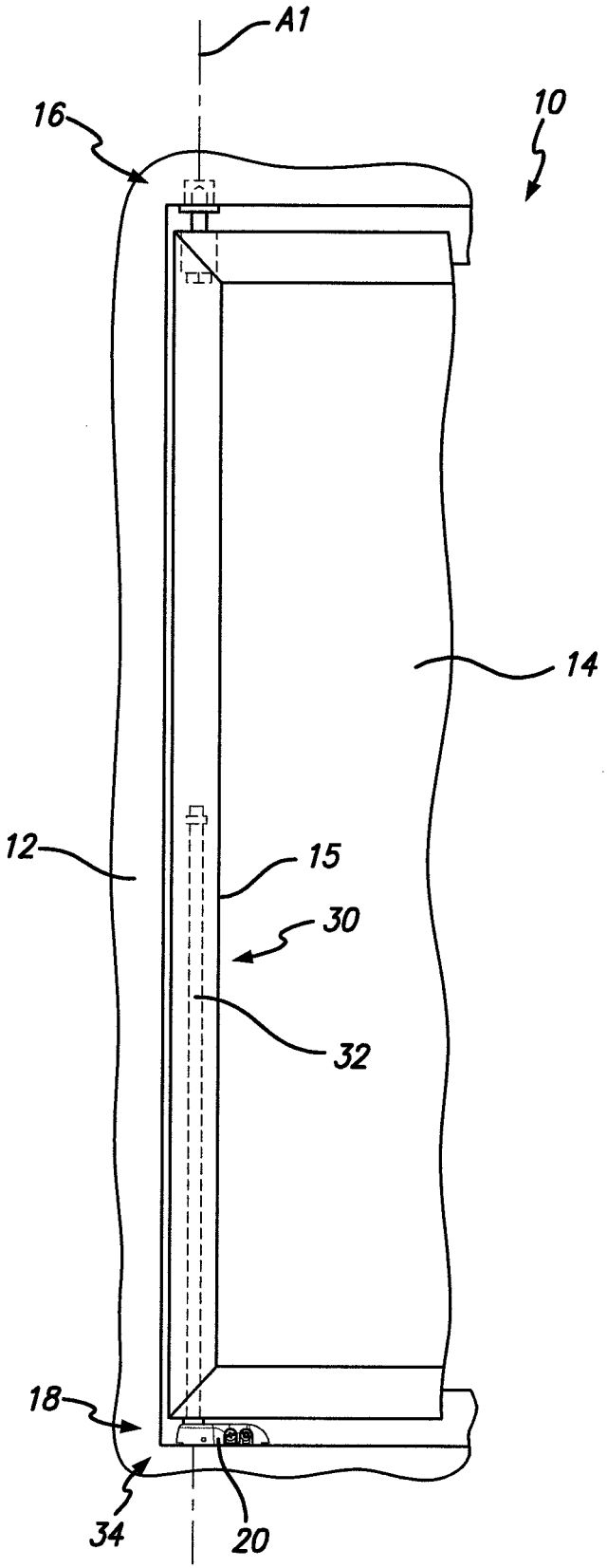
FIG. 1 is a partial elevation view of a refrigerator door showing the installed side adjustable torque application mechanism of the present invention.

The following description and drawings are illustrative and are not to be construed as limiting. Numerous specific details are described to provide a thorough understanding of the disclosure. However, in certain instances, well-known or conventional details are not described in order to avoid obscuring the invention. References to "one" or "an" embodiment in the present disclosure can be, but are not necessarily references to the same embodiment; but, such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," and "below" used herein are merely for ease of description and refer to the orientation of the components as shown in the figures and are not intended to be limiting.

Referring to FIG. 1, there is shown a conventional commercial refrigerator door assembly 10 with the torque rod adjustment and hinge pin socket device or side adjustable torque application mechanism 20 of the present invention installed. It will be understood that by "side adjustable" it is meant the side of the device 20, which faces the outside of the display case. As shown in FIG. 1, this provides adjustability from the front of the door/cabinet. Also, the device 20 is reversible and provides adjustment from both sides (from the front or the back with respect to the door/cabinet). The door assembly 10 comprises a cabinet 12 having a top horizontal frame member, a bottom horizontal frame member, and two side frame members, only the left cabinet frame member appearing complete in the fragmentary view of FIG. 1. The door assembly 10 also comprises the door 14 with its peripheral frame 15.

Shown at the top of FIG. 1 is a conventional door hinge assembly 16, wherein a hinge pin is fixedly secured to the door 14 and protrudes upwardly, and is received by a hinge pin socket disposed and fixed in the top horizontal frame member of the cabinet 12. Shown at the bottom of FIG. 1 is the lower door hinge assembly 18, whose differences from the conventional door hinge will be described hereinafter. The upper door hinge assembly 16 and the lower door hinge assembly 18 together define the door's pivot axis A1 about which the door swings.

Also present in the door assembly 10 of FIG. 1 is a torque rod assembly 30 which is conventional in all respects except for the features to be described hereinafter. The torque rod assembly 30 serves to provide a biasing force which is used to close the door 14 when it is released in the open position and bias it to maintain the door in the closed position. The torque rod assembly 30 (also see FIG. 5) comprises the torque rod 32, a torque rod anchor member integral with the door 14 and housed within the side door frame 15, and a torque rod anchor 34 secured to the lower horizontal structural member of the cabinet 12.

The upper end of the torque rod 32 has a non-circular shape (e.g. key shape) which is matingly received and secured in a mating aperture (e.g. key hole) in the upper torque rod anchor. This secure attachment prevents relative rotation between the upper end of the torque rod 32 and the door 14. It will be understood that the hinge assemblies and associated components and the torque rod assembly are not a limitation on the present invention and that other types of hinge assemblies, e.g., an electrical hinge pin assembly can be used.

Figure 5:
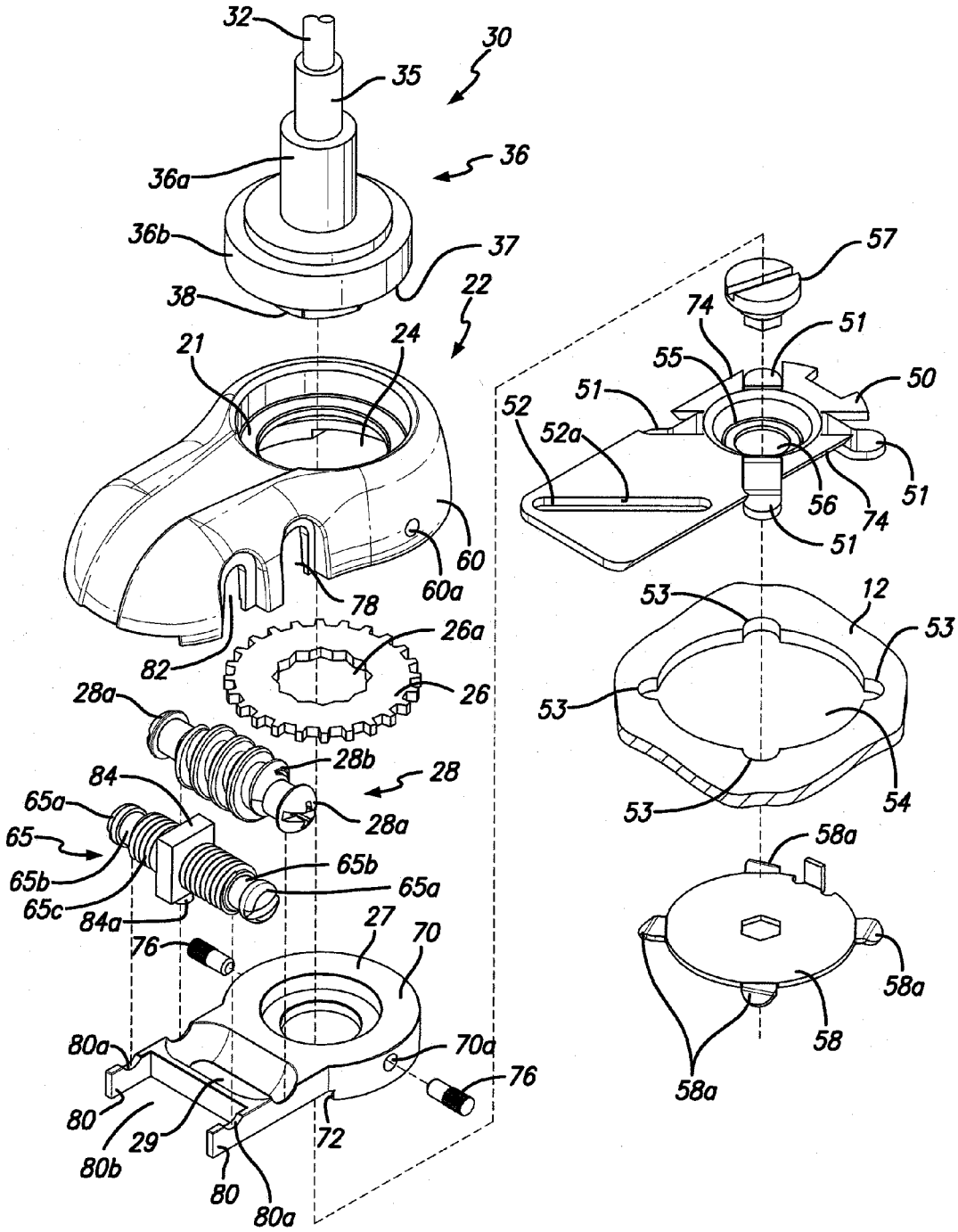
FIG. 5 is an exploded view of the side adjustable torque application mechanism of FIG. 1 in association with the end of a torque rod assembly.
Figure 6:
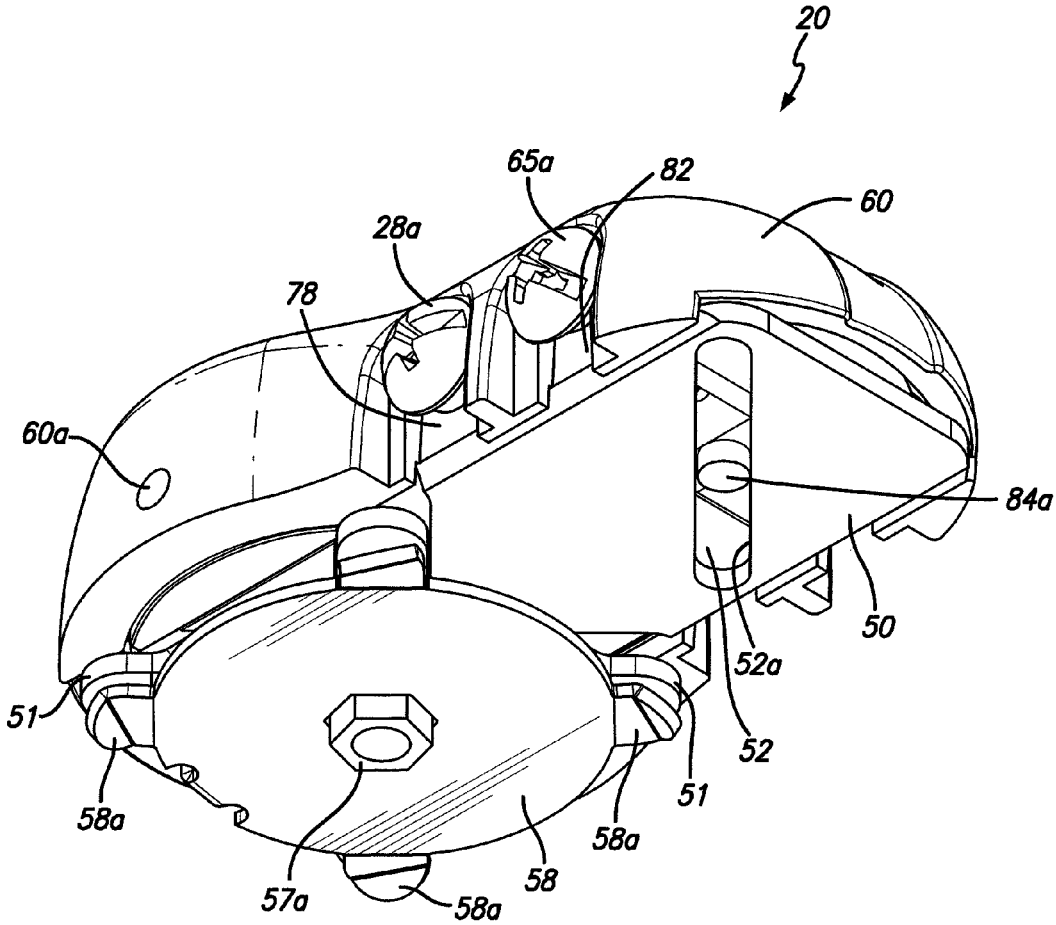
FIG. 6 is a bottom perspective view of the side adjustable torque application mechanism of FIG. 1.

Turning now to FIGS. 2-5, and in particular to FIG. 5, there is shown a preferred embodiment of the present invention. This embodiment is intended for use as the bottom pivot point of the door, although it will be appreciated by those skilled in the art that it could be used as well as the top pivot point of the door.

FIG. 5 is an exploded view of a preferred embodiment of the invention. The torque rod assembly 30 as shown in the preferred embodiment comprises a torque rod 32. The torque rod 32 may be, for example, of selected spring steel of high fatigue resistance and which retains its torsional resiliency during many years of use when forcibly twisted through an arc of 90° or more. A sleeve 35, preferably plastic, loosely surrounds the rod 32 for essentially the entire length of the rod 32. This sleeve 35 protects the rod 32 from contacting other components in the door and facilitates its operation. Disposed near the end of the torque rod 32 is a hinge pin 36 which comprises a cylindrical sleeve portion 36*a* and an integral enlarged shoulder portion 36*b*. A circular orifice runs through the middle of the hinge pin 36 through which the torque rod 32 freely passes. The hinge pin 36 functions as follows, the sleeve portion 36*a* is disposed in and is free to rotate within an aperture in the bottom side of the door frame 15, and the enlarged shoulder 36*b* is received in the hinge pin socket 22 of the device 20. It is also preferable to position a friction-reducing cup 37 around the bottom of the hinge pin 36 which can rotate relative to the enlarged shoulder portion 36*b*. Because the entire weight of the door 14 is transmitted to the bottom surface of shoulder 36*b*, and this weight is then borne by the annular hinge pin socket seating surface 21, the friction-reducing cup 37 provides a desirable reduction in friction between the relative rotating surfaces; however, this is not a limitation on the present invention. At the very end of the torque rod 32 and integral therewith is a hexagonal head 38 which mates with the device 20 in such a way that the torsion of the torque rod can be adjusted. Although a hexagonal shape is disclosed as the preferred embodiment, any shape or means that can lockingly mate with the worm wheel to be hereinafter described can be employed (e.g. any non-circular shape).

In a preferred embodiment, the device 20 includes a base member 50, a cover 60, an intermediate member 70, a torque adjustment mechanism 71 for adjusting the torque of the torque rod, and a lateral adjustment mechanism 73 for adjusting the lateral position of the hinge pin socket.

Figure 2:
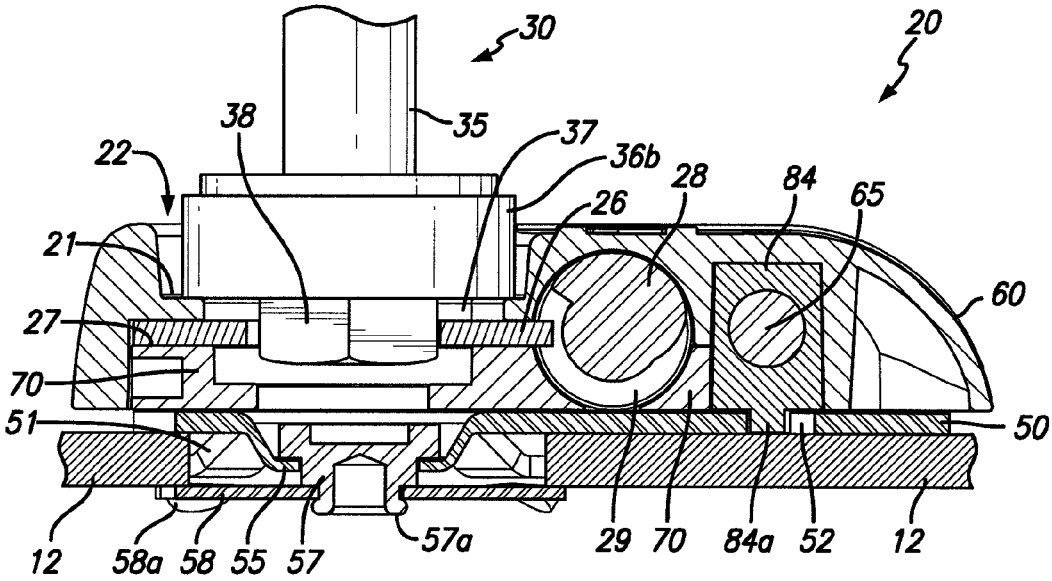
FIG. 2 is a side sectional elevational view of the side adjustable torque application mechanism of FIG. 1.
Figure 3:
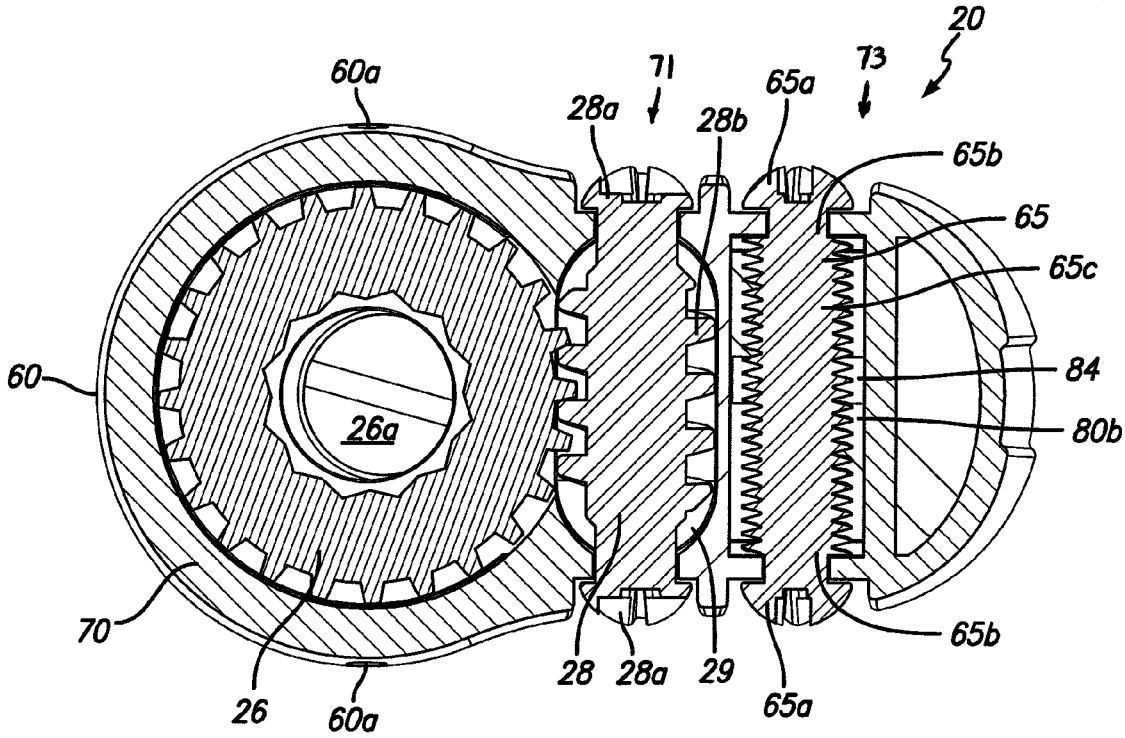
FIG. 3 is a bottom sectional plan view of the side adjustable torque application mechanism of FIG. 1.
Figure 4:
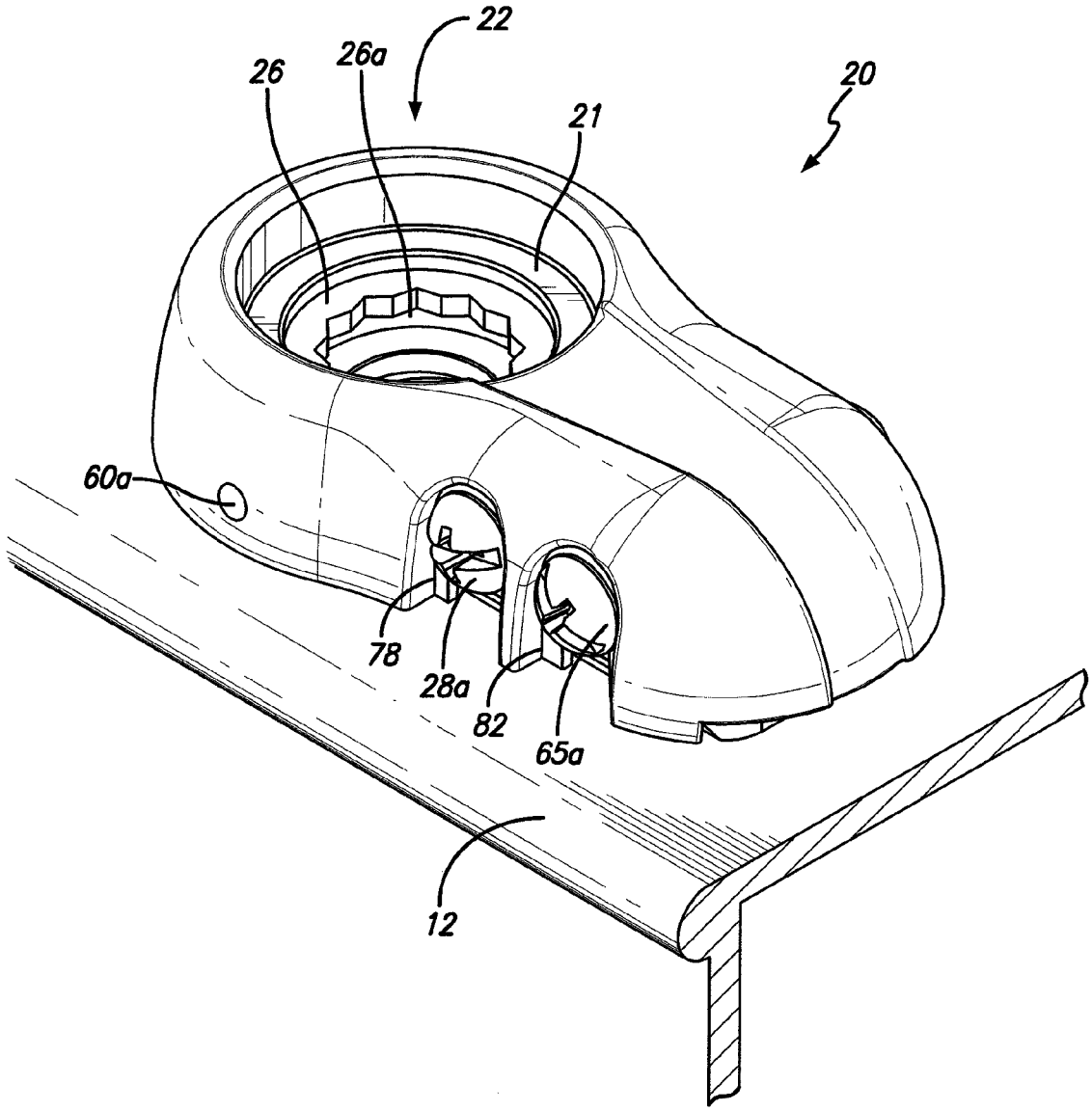
FIG. 4 is a perspective view of the side adjustable torque application mechanism of FIG. 1.

The base member 50, best seen in FIG. 5, is intended to fixedly attach the device 20 to the cabinet 12. In order to utilize the orifices presently found in some cabinets which use a conventional anchor socket, the base member 50 is provided with four legs 51 which seat in the four mating recesses 53 circumferentially spaced about the edge of aperture 54. Once the base member 50 is positioned over the aperture 54 it cannot move laterally relative to the cabinet 12, nor rotate in the aperture 54. In order to prevent the base member 50 from lifting out of the aperture 54, the following method of assembly is used. The base member 50 is provided with a centrally located and downwardly-protruding nipple 55 having a rivet receiving orifice 56 therein and a screw head rivet 57 is inserted through the rivet-receiving orifice 56 from above and is further inserted into the receiving orifice of a locking element 58. This locking element 58 is flat and has four circumferentially spaced protrusions and is shaped so that it can mate with but pass through the aperture 54. As seen in FIG. 2, the base member 50, the rivet 57, and the locking element 58 are attached to each other. FIG. 2 shows rivet 57 with its end 57*a* flattened so as to retain the locking element 58. The rivet 57 is sized so that it is tightly received by the orifice in the locking element 58 so that the locking element 58 can be rotated by turning the rivet 57. When installing the base member 50, the locking element 58 is rotated so that its protrusions 58*a* rest on the legs 51 integral with the base member 50. This positioning allows the locking element 58 to pass through the aperture 54 when the base member 50 is lowered onto the cabinet 12, then by turning the rivet 57, the locking element 58 is rotated and the protrusions 58*a* now are locked behind the underside of the cabinet 12, thereby preventing withdrawal of the base plate 50 from the cabinet 12.

Figure 7:
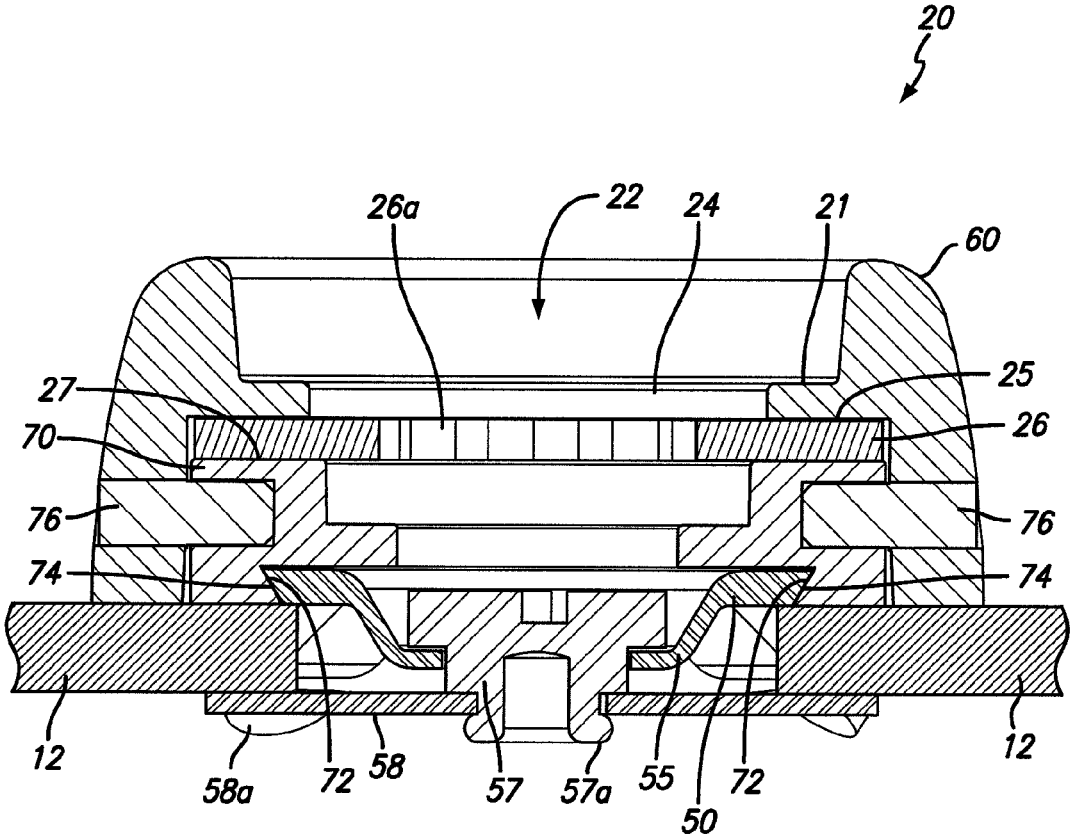
FIG. 7 is a front sectional elevational view of the side adjustable torque application mechanism of FIG. 1.

As is shown in FIG. 5, the intermediate member 70 includes a female dovetail chamfer 72 that mates with a male dovetail chamfer 74 on the base member 50 (see FIG. 7), to prevent the intermediate member 70 and cover member 60 from moving upwardly, but that allows the intermediate member 70, cover member 60 and associated components to move laterally so that the sag or position of the hinge pin socket can be adjusted.

In a preferred embodiment, the cover 60 is attached to the intermediate member 70 via pins 76 that are press fit into openings 70*a* and 60*a* in the intermediate member 70 and cover member 60, respectively. It will appreciated that other methods for connecting the intermediate member 70 and cover member 60 are within the scope of the present invention. The cover member 60 serves at least two functions: (1) it provides a socket for the bottom hinge pin 36; and (2) it provides an anchor for the bottom end 38 of the torque rod 32. The cover 60 is provided with a recessed annular seating surface 21 which is circular and sized to mate with the hinge pin 36 and to allow it to rotate within the socket. A torque rod orifice 24 is provided in the center of the hinge pin socket 22 sized to receive the hexagonal head 38 at the end of the torque rod 32.

In a preferred embodiment, the torque adjustment mechanism 71 comprises a worm gear mechanism that is housed between the cover 60 and the intermediate member 70, and comprises a worm wheel 26 and a worm 28. The worm wheel 26 is positioned adjacent to the surface 25 which is the underside of the hinge pin socket seating surface 21 and the upper surface 27 of the intermediate member 70. The center of the worm wheel 26 has an aperture 26*a* which is shaped to matingly receive the hexagonal head 38 of the torque rod 32, such that the worm wheel 26 and the bottom end of the torque rod are rotatively engaged. The upper surface 27 of the intermediate member 70 is adapted to shield the rotating worm wheel 26 from extraneous parts and to hold it in position. The worm 28 is housed in a channel 29 in intermediate portion 70 (that has a mating portion defined in the cover 60) and includes screw heads 28*a* on opposite ends thereof that extend through worm openings 78 in the cover 60 and includes a gear portion 28*b*. The worm 28 is disposed perpendicularly to the lateral extension of the cabinet 12 so that the screw heads 28*a* on the ends of the worm 28 are accessible to a screwdriver or other implement for turning. It can therefore be seen that by turning the worm 28 the worm wheel 26 is rotated which rotates the hexagonal head 38 of the torque rod, and thereby allows fine and continuous adjustment of the torque rod.

Turning our attention now to the hinge pin socket lateral adjustment mechanism 73, it is frequently desirable to adjust the lateral position of the hinge pin socket 22, either to the left or to the right (from the perspective of facing the door) to vary the angle of the door's pivot axis to compensate for any sag or misalignment in the door.

The hinge pin socket lateral adjustment mechanism of this invention is provided for in a preferred embodiment in a manner to be now described. The base member 50 is provided with an angular slot 52 defined therein. The intermediate portion 70 is provided with two flanges 80 that each include an indentation 80*a* defined therein and that define a space 80*b* therebetween. An adjustment screw 65 with two heads 65*a* on opposite ends thereof, two non-threaded portions 65*b* and a threaded portion 65*c* is provided. The adjustment screw 65 is positioned on the intermediate portion 70 such that the non-threaded portions 65*b* rest in indentations 80*a* and the threaded portion 65*c* spans space 80*b*. The heads 65*a* extend through screw openings 82 in the cover 60, which are preferably positioned adjacent worm openings 78. The threaded portion 65*c* of the adjustment screw 65 includes a peg nut 84 received thereon. The peg nut 84 has a boss 84*a* extending therefrom that extends through and is captured by angular slot 52. In an embodiment, the screw 65 can be provided with a lock nut that is disposed around the screw 65 on the inside surface of the cover 60. This lock nut serves to prevent the screw 65 from moving relative to the cover 60.

In use, when the lateral adjustment screw 65 is rotated by turning the screw head 65*a*, the threaded engagement of the screw 65 with the peg nut 84 causes the peg nut 84 to move axially along the screw 65. As a result of the axial movement of the peg nut 84, the boss 84*a* bears against the bearing surface 52*a* of the angular slot 52. Because the base portion 50 is anchored to the frame 12, the action of the boss 84*a* bearing against bearing surface 52*a* causes the intermediate portion 70 and cover 60 to move longitudinally (or side to side with respect to the door), thereby changing the lateral position of the hinge pin socket 22.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, if only one aspect of the disclosure is recited as a means-plus-function claim under 35 U.S.C. §112, ¶6, other aspects may likewise be embodied as a means-plus-function claim, or in other forms, such as being embodied in a computer-readable medium. (Any claims intended to be treated under 35 U.S.C. §112, ¶6 will begin with the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A device for use in a door assembly that is positioned in a cabinet and defines a pivot axis, the device comprising:

a base member adapted to be fixedly secured to the cabinet, wherein the base member includes a diagonally oriented slot defined therein, an intermediate member slidingly engaged with the base member, wherein the intermediate member includes a transversely extending adjustment screw associated therewith that defines an axis and has at least one head and a threaded portion with a peg nut thereon, wherein the peg nut includes a boss extending downwardly into the diagonally oriented slot of the base member, a cover connected to the intermediate member and having a hinge pin socket therein, wherein the cover includes an opening defined therein through which the head of the adjustment screw extends, wherein rotation of the adjustment screw causes the boss to move along the diagonally oriented slot which causes the intermediate member and the cover to move in a direction substantially perpendicular to the adjustment screw axis.

2. The device of claim 1 wherein the adjustment screw includes two non-threaded portions positioned axially on either side of the threaded portion, and wherein the non-threaded portions each are seated in an indentation defined in the intermediate portion.

3. The device of claim 2 wherein the adjustment screw includes a head on each end thereof, and wherein the cover includes openings on each side thereof through which one of the heads of the adjustment screw extends.

4. The device of claim 1 wherein the intermediate member and base member comprise mating angled surfaces that prevent the intermediate member from moving upwardly and that allow the intermediate member and cover to slide in the direction substantially perpendicular to the axis defined by the adjustment screw.

5. The device of claim 1 further comprising a worm wheel rotatively housed in the cover and having a central aperture adapted to matingly receive the end of a torque rod of the door assembly in a non-rotative relationship; and a worm housed by the cover in engaging relationship with the worm wheel and adapted to be selectively turned so as to adjust the torque of the torque rod.

6. The device of claim 5 wherein the worm is seated in a channel defined in the intermediate member.

7. The device of claim 1 further comprising a torque adjustment mechanism that is adapted to adjust the torque of a torque rod of the door assembly.

8. The device of claim 7 wherein the torque rod adjustment mechanism includes a worm and a worm wheel, wherein the worm is rotatable about a second axis that is substantially parallel to the adjustment screw axis.

* * * * *